US006514358B1

(12) United States Patent
Bartholomeusz et al.

(10) Patent No.: US 6,514,358 B1
(45) Date of Patent: Feb. 4, 2003

(54) STRETCHING OF MAGNETIC MATERIALS TO INCREASE PASS-THROUGH-FLUX (PTF)

(75) Inventors: Michael Bartholomeusz, Phoenix, AZ (US); Michael Tsai, Phoenix, AZ (US)

(73) Assignee: Heraeus, Inc., Chandler, AZ (US)

( * ) Notice: Subject to any disclaimer, the term of this patent is extended or adjusted under 35 U.S.C. 154(b) by 0 days.

(21) Appl. No.: 09/826,421

(22) Filed: Apr. 5, 2001

Related U.S. Application Data

(60) Provisional application No. 60/194,585, filed on Apr. 5, 2000.

(51) Int. Cl.[7] ..... H01F 1/04

(52) U.S. Cl. ..... 148/300; 148/310; 148/311; 148/312; 148/313; 148/315; 148/120; 148/121; 204/298.12; 204/298.13

(58) Field of Search ..... 148/300, 310, 148/311, 312, 313, 315, 120, 121; 204/298.12, 298.13, 298.16, 298.17, 298.21, 298.19, 298.2

(56) References Cited

U.S. PATENT DOCUMENTS

| | | | | |
|---|---|---|---|---|
| 1,586,877 A | | 6/1926 | Buckley | |
| 1,801,150 A | | 4/1931 | Goldschmidt et al. | |
| 3,568,171 A | | 3/1971 | Lesher | |
| 4,053,331 A | | 10/1977 | Graham, Jr. et al. | |
| 4,832,810 A | | 5/1989 | Nakamura et al. | |
| 4,842,706 A | * | 6/1989 | Fukasawa et al. | 204/298 |
| 4,941,920 A | | 7/1990 | Inui et al. | |
| 5,112,468 A | | 5/1992 | Weigert et al. | |
| 5,282,946 A | | 2/1994 | Kinoshita et al. | |
| 5,334,267 A | | 8/1994 | Taniguchi et al. | |
| 5,468,305 A | | 11/1995 | Uchida et al. | |
| 5,685,921 A | | 11/1997 | Dulmaine | |
| 6,086,725 A | | 7/2000 | Abburi et al. | |
| 6,123,783 A | | 9/2000 | Bartholomeusz et al. | |
| 6,176,944 B1 | | 1/2001 | Snowman et al. | |
| 6,190,516 B1 | | 2/2001 | Xiong et al. | |

OTHER PUBLICATIONS

W. Xiong, et al " *Cobalt Alloys And The Search For 10–Gbit/In*$^2$ *Recording*" Data Storage Technology & Manufacturing Of Storage Devices, 1996, 3 total pages.

S.D. Harkness, et al "*Effect Of Target Processing On CoCrPtTa Thin–Film Media*" J. Mater. Res., vol. 15, No. 12, Dec. 2000, pp. 2811–2813.

* cited by examiner

*Primary Examiner*—John Sheehan
(74) *Attorney, Agent, or Firm*—McDermott, Will & Emery

(57) ABSTRACT

Magnetic materials for use in sputtering targets are hot rolled and stretched at ambient temperature or at a temperature not exceeding 1400° F. The magnetic material can be pure Co, pure Ni, or Co based alloys.

22 Claims, 1 Drawing Sheet

Effect of Stretch Deformation on Pass-Through-Flux

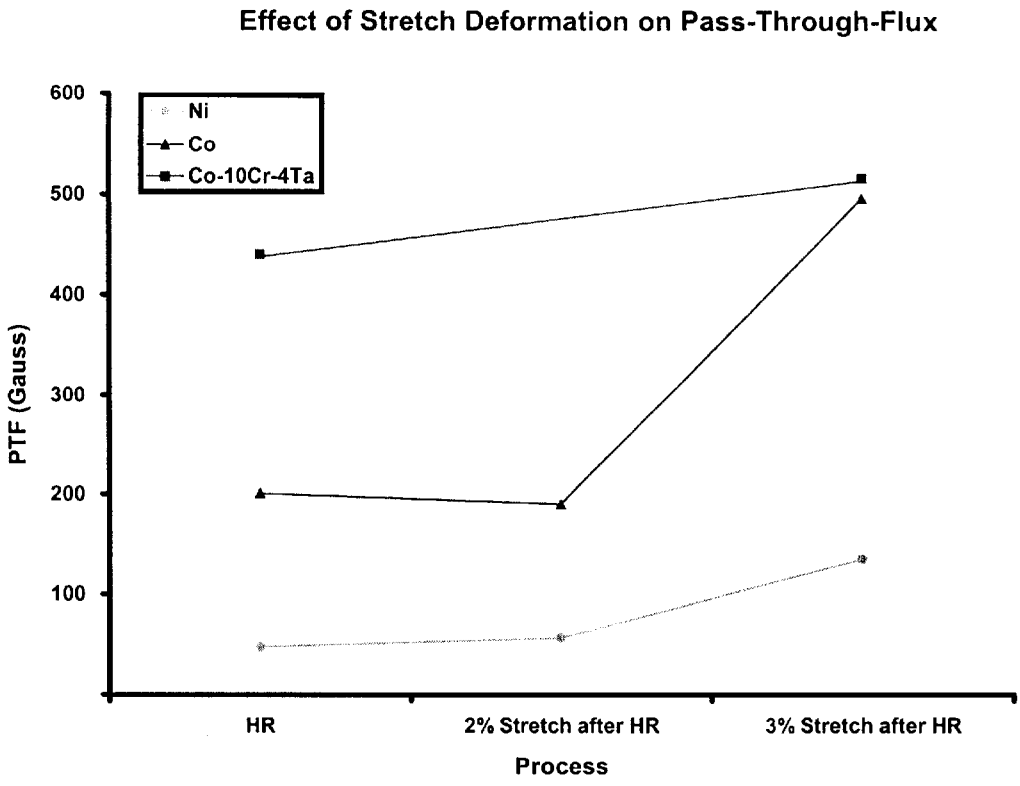
Effect of Stretch Deformation on Pass-Through-Flux
Ni
Co
Co-10Cr-4Ta
600
500
400
300
200
100
PTF (Gauss)
HR
2% Stretch after HR
3% Stretch after HR
Process

STRETCHING OF MAGNETIC MATERIALS TO INCREASE PASS-THROUGH-FLUX (PTF)

CROSS-REFERENCE TO RELATED APPLICATIONS

This application claims priority from Provisional Patent Application Ser. No. 60/194,585, filed Apr. 5, 2000, the entire disclosure which is incorporated herein by reference.

FIELD OF INVENTION

The invention relates to stretching magnetic materials for use as sputtering targets to increase the pass through flux (PTF) of the magnetic material being sputtered and to decrease the permeability of the magnetic material.

BACKGROUND OF THE INVENTION

The PTF of a magnetic sputtering target is defined as the ratio of transmitted magnetic field to the applied magnetic field. A PTF value of 100% is indicative of a non-magnetic material where none of the applied field is shunted through the bulk of the target. The PTF of magnetic target materials is typically specified in the range of 0 to 100%, with the majority of commercially produced materials exhibiting values between 10 to 95%. However, the PTF can be also expressed as an absolute value of the transmitted field in units of gauss instead of a percent.

There are several different techniques for measuring product PTF. One technique involves placing a 4.4±0.4 kilogauss bar magnet in contact on one side of the target material and monitoring the transmitted field using an axial Hall probe in contact with the other side of the target material. The maximum value of the magnetic field transmitted through the bulk of the target, or the maximum value transmitted, divided by the applied field strength in the absence of the target between the magnet and probe, which is maintained at the same distance apart as when the target was between them, is defined as the PTF. Another technique for measuring PTF involves using a horseshoe magnet and a transverse Hall probe.

The PTF values measured using different magnet and probe arrangements are found to exhibit good linear correlation for the values of magnet field strength typically utilized in the industry. The PTF measurement techniques are constructed to realistically approximate the applied magnetic flux occurring in an actual magnetron sputtering machine. Therefore, PTF measurements have direct applicability to a target material's performance during magnetron sputtering.

Magnetron cathode sputtering involves the arrangement where permanent magnets or electromagnets are positioned behind a target material (cathode) and applying a magnetic field to the target. The applied magnetic field transmits through the target and focuses a discharge plasma onto the front of the target. The target front surface is atomized by an ion beam with subsequent deposition of atoms from the target material onto the surface of a substrate positioned adjacent to the target to form a thin film on the substrate.

The use of magnetron sputtering to deposit thin films of magnetic target materials is wide spread in the electronics industry, particularly in the fabrication of semiconductor and data storage devices. Due to the magnetic nature of the target materials, there is considerable shunting of the applied magnetic field in the bulk of the target. This in turn results in reduced target utilization due to focussing of the transmitted magnetic field in the erosion groove formed as a result of the shunting. This focussing effect is exacerbated with increasing material permeability which corresponds to decreasing material PTF.

It is well known that reducing target material permeability or increasing the target material PTF promotes less severe erosion profile, thus enhancing target material utilization during the sputtering process. This leads to a net reduction in target material cost per unit sputter fabricated product. Furthermore, the presence of severe target erosion profiles can also lead to a point source sputtering phenomena which can result in a deposited thin film that lacks thickness uniformity. Therefore, in addition to less severe erosion profile, increasing the PTF of the target material has the added benefit of increasing the uniformity of the thickness of the deposited thin film.

Magnetic material PTF and permeability (i.e., the ratio of magnetic flux density produced in a medium to the magnetizing force producing it) are not mutually exclusive. Rather, there is a very strong inverse correlation between PTF and maximum permeability of magnetic material. Values of material magnetic permeability can be very precisely determined using a vibrating-sample-magnetometer (VSM) technique in accordance with ASTM Standard A 894-89. Descriptions of sample geometry and calculation of the appropriate demagnetization factors for permeability determination are well known in the art. See, for example, Bozarth, *Ferromagnetism*, p. 846.

Magnetic target PTF is a strong function of both target chemistry and the thermomechanical techniques utilized during target fabrication. For alloys that do not possess inherently high PTF as a result of their stoichiometry, i.e., PTF<85%, it is possible to increase product PTF by various thermomechanical manipulations during product fabrication. For example, the typical fabrication of Ni, Co and Co-alloy targets involves casting, hot-rolling and either heat treatment or cold-rolling or a combination of heat treatment followed by cold-rolling. It is known that heat treating and cold-rolling of magnetic target materials can increase product PTF. Heat treatment of Co-Cr-Ta-(Pt) alloys below 2200° F. has been shown to increase the PTF by promoting matrix crystallographic phase transformation from face centered cubic to hexagonal closed packed. Chan et al., *Magnetism and Magnetic Materials*, Vol. 79, pp. 95–107 (1989). It is suggested in Weigert et al., *Mat. Sci. and Eng.*, A 139, pp 359–363 (1991), that cold-rolling of an alloy comprising 62–80 atomic % Co, 18–30 atomic % Ni and 0–8 atomic % Cr immediately after the hot-rolling step results in an increase in product PTF. A similar result is disclosed in Uchida et al., U.S. Pat. No. 5,468,305 for an alloy containing 0.1–40 atomic % Ni, 0.1–40 atomic % Pt, 4–25 atomic % Cr and the remainder Co which is cold-rolled by not more than a 10% reduction after the hot-rolling process. Uchida et al. claim that the cold-deformation induced internal strain in the alloy reduces magnetic permeability.

U.S. Pat. No. 1,586,877 discloses heating treating a nickel-iron alloy and then placing it under tension to stabilize permeability. The patentee discloses that the relationship between permeability and tension for any particular nickel-iron alloy is dependent on the heat treatment. If a wire of about 78% nickel and about 22% iron is mechanically worked and then annealed at a temperature of 800° C. for a few minutes and allowed to cool in air, the alloy shows a rapid decrease of permeability with tension when measured with a field strength of 0.01 gauss whereas a similar wire heat treated at 1100° C. and measured at the same field strength shows a tremendous increase of permeability with tension.

U.S. Pat. No. 1,801,150 discloses a process of treating magnetic materials such as a nickel-iron alloy to increase the consistency of permeability of the magnetic material by a process wherein the material is successively annealed and elongated. The example in the patent discloses annealing an iron-nickel alloy in bar form at 800° to 900° C. for about an hour, then elongating the bar to such an extent that a cross-section of the bar is reduced by 10%; annealing the bar for an hour at 900° C., again elongating the bar while cold; and so on. The annealing and elongation steps are repeated three times. After the third annealing, the alloy is elongated in a cold state until the cross-sectional reduction amounts to about 60–79%. The resulting product has magnetic stability.

U.S. Pat. No. 4,053,331 discloses that the magnetic permeability of amorphous metallic alloys are improved by application of stress. In this patent, alloys in ribbon form are subjected to controlled tensile stress. The advantages of this process include low field properties and permeability which exceed those of permalloys.

The goal in each of these U.S. patents is to use tension to increase permeability, i.e., decrease PTF, of soft Ni-Fe alloys. This goal is opposite to that desired with respect to magnetic target alloys used in magnetron sputtering. The inventors have discovered that the PTF of such magnetic target alloys can be increased and the permeability decreased by using the combined steps of hot rolling and stretching the alloy material. These combined steps are not disclosed, taught or suggested by the prior art.

SUMMARY OF THE INVENTION

The object of this invention is to provide a process for preparing a magnetic material for use as a target for magnetron cathode sputtering and depositing thin films of magnetic material having increased PTF and decreased permeability. It is a further object of the present invention to provide a sputtering target for use in magnetron cathode sputtering which is prepared by stretching. It is a further object of the invention to provide sputtered thin magnetic films having uniform thickness. To accomplish the object described above according to the present invention, there is provided a process of hot rolling the magnetic material and then stretching it at least 3% and up to 16%. Other objects and characteristics of the present invention will become apparent from the further disclosure of the invention which is given hereinafter with reference to the accompanying drawing.

BRIEF DESCRIPTION OF THE DRAWING

In the accompanying drawing, the FIGURE graphically shows the effect of stretch deformation on PTF for three magnetic target materials, namely, pure Co, pure Ni, and a Co based alloy.

DETAILED DESCRIPTION OF THE INVENTION

The process described herein can be used in the fabrication of magnetic materials for use as targets for magnetron sputtering processes. Typical target materials include, but are not restricted to, the following: pure Co, pure Ni, and Co based alloys. The Co based alloys comprise Co alloyed with elements such as Cr, Pt, B, Ta, Ni, Nb, Zr, C, Fe or mixtures thereof where the total content of the individual elements in the alloy ranges between 0 to 30 atomic %. However, the total content of these elements should not exceed 80 atomic %.

The magnetic target material is formed into an ingot and hot rolled into a plate or into a form which could be used as a sputtering target. The thickness of the plate or form ranges from about 0.100 inches to 0.800 inches. The plate or form is quenched in cold water and then machined to a thickness of between 0.050 to 0.750 inches.

The machined plate or form is cleaned and stretched using a machine called a stretcher. This machine typically possesses two jaws that clamp on either end of the plate being processed. The jaws then mechanically exert tension on the plate and mechanically elongate the plate or form. The plate accommodates the permanent elongation via plastic deformation. The stretching process can be done from ambient temperature up to, but not exceeding, 1400° F. Ambient temperature means room temperature, that is, from 20° to 25° C. Stretching is a very rapid and uniform process, typically only consuming between 2 to 30 minutes to accomplish and therefore lends itself to the rapid and cost effective volume production of high-PTF materials. The target material should be stretched to obtain at least a 3% elongation . The maximum elongation at room temperature is 10%. Stretching beyond 10% at ambient temperature results in non-uniform plate deformation and cleavage. The maximum elongation at 1400° F. is 16%.

The stretching process can be done in a single step or in multiple steps. The multiple step process involves stretching the plate or form and then relaxing the stretching, i.e., releasing the tension on the plate or form, and then stretching and relaxing the plate again or for a multiple number of times to achieve final elongation of the plate or form. For example, if it is desired to stretch the plate or form to 6% of its original length, the form or plate is stretched to 2% of its original length and relaxed, then stretched again to 2% of its original length and relaxed, and again stretched to 2% of it original length and relaxed. However, the stretching does not have to be done in equal segments. It can be done using multiple stretching steps using different tensions. For instance, if it is desired to stretch a plate or form to 10% of its original length, the plate or form can be first stretched to 8% of its original length and relaxed, and then stretched to 2% of it original length and relaxed to provide a plate or form which is 10% of its original length.

The following example illustrates three specific embodiments of the invention, but they are not considered as limiting the invention in any manner.

EXAMPLE

Pure nickel, pure cobalt, and Co-10Cr-4Ta are each cast into a 1.3" thick ingot by a conventional vacuum induction melt process. The ingot of pure nickel is straight hot rolled at 1800° F. into a nickel plate having a thickness of 0.300 inches. The plate is quenched in cold water. The ingot of pure cobalt is straight hot rolled at 1800° F. into a cobalt plate having a thickness of 0.300 inches and then quenched in cold water. The ingot of Co-10Cr-4Ta is straight hot rolled at 2200° F. into a cobalt alloy plate having a thickness of 0.300 inches thick and then quenched in cold water.

The top and bottom surfaces of each plate are machined to 0.250 inches thick. The surfaces are cleaned as much as possible. Each plate is cut into 3 equal parts, each measuring 24 inches long×5.5 inches wide×0.250 inches thick. The first part is not stretched. The second part is stretched to obtain 2% elongation at ambient temperature. The third part is stretched to obtain 3% elongation at ambient temperature. Markers were scribed on the second and third parts at one inch intervals along total length of plate in order to gauge % stretch obtained.

The accompanying drawing demonstrates the surprising change in PTF when these magnetic materials are stretched.

The PTF is measured by placing a 4.4±0.4 kilogauss bar magnet in contact on one side of the target material and monitoring the transmitted field using a axial Hall probe in contact on the other side of the target material. This technique is a fairly accurate representation of the type of fields experienced by the target in an actual magnetron machine. The results shown in the FIGURE compare the three parts of each of the magnetic materials tested, i.e. pure Ni, pure Co, and a Co based alloy comprising Co-10Cr-4Ta. The PTF is calculated after hot rolling (HR) without elongation, after hot rolling with 2% elongation and after hot rolling with 3% elongation. The results indicate that stretching at 3% elongation after hot rolling provides unexpected improvement in the PTF in each of the magnetic materials.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalence thereof may be resorted to, falling within the scope of the invention claimed.

What is claimed is:

1. A process for fabricating magnetic materials for use as sputtering targets comprising the steps of hot rolling a magnetic material and stretching said magnetic material to increase the pass through flux value of the magnetic material, wherein the stretching of said material is from 3% to 16% of its original length.

2. The process of claim 1, wherein the magnetic material is selected from the group consisting of Co, Ni, and a Co based alloy having at least one element selected from the group consisting of Cr, Pt, B, Ta, Ni, Nb, Zr, C, Fe and mixtures thereof.

3. The process of claim 2, wherein the magnetic material is a Co alloy wherein the total content of said element does not exceed 80 atomic %.

4. The process of claim 2, wherein the content of said element is up to 30 atomic %.

5. The process of claim 1, wherein said stretching step is done at ambient temperature.

6. The process of claim 5, wherein the stretching of said magnetic material is from 3% of its original length.

7. The process of claim 1, wherein said stretching step is done at a temperature not exceeding 1400° F.

8. The process of claim 7, wherein the stretching of said material is from 3% to 10% of its original length.

9. The process of claim 1, wherein the magnetic material is Co.

10. The process of claim 1, wherein the magnetic material is Ni.

11. The process of claim 1 wherein the magnetic material is Co-10Cr-4Ta.

12. The process of claim 1, wherein the stretching step includes three sequential steps of stretching and relaxing said material at ambient temperature, each stretching step stretching said material 2% of its original length to provide said material that is stretched 6% of original length.

13. The process of claim 1, wherein the stretching step includes an initial step of stretching said material 8% of its original length at room temperature and relaxing the stretched material and then stretching said relaxed material another 2% of its original length to provide said material that is stretched 10% of its original length.

14. A magnetic sputtering target for use in magnetron cathode sputtering comprising a magnetic material having been prepared by hot rolling a magnetic material and stretching said magnetic material to increase the pass through flux value and decrease permeability of the magnetic material, wherein said material is stretched from 3% to 16% of its original length.

15. The product of claim 14, wherein the magnetic material is selected from the group consisting of Co, Ni, and a Co based alloy having at least one element selected from the group consisting of Cr, Pt, B, Ta, Ni, Nb, Zr, C, Fe and mixtures thereof.

16. The product of claim 15, wherein the magnetic material is a Co alloy wherein the total content of said element does not exceed 80 atomic %.

17. The product of claim 15, wherein the content of said element is up to 30 atomic %.

18. The product of claim 14, wherein the stretching of said magnetic material is from 3% of its original length.

19. The product of claim 14, wherein the stretching of said material is from 3% to 10% of its original length.

20. The product of claim 14, wherein the magnetic material is Co.

21. The product of claim 14, wherein the magnetic material is Ni.

22. The product of claim 15, wherein the magnetic material is Co-10Cr-4Ta.

* * * * *